US008136873B2

(12) United States Patent
Fritsch et al.

(10) Patent No.: US 8,136,873 B2
(45) Date of Patent: Mar. 20, 2012

(54) FOLDABLE REST SUPPORT

(75) Inventors: Denis Fritsch, Nieul sur Mer (FR); Frederic Frilloux, Chevilly Larue (FR)

(73) Assignees: Denis Fritsch, Nieul sur Mer (FR); Frederic Frilloux, Chevilly Larue (FR); Stephane Vue, Nieul sur Mer (FR)

( * ) Notice: Subject to any disclaimer, the term of this patent is extended or adjusted under 35 U.S.C. 154(b) by 176 days.

(21) Appl. No.: 12/301,634

(22) PCT Filed: Apr. 25, 2007

(86) PCT No.: PCT/EP2007/054073

§ 371 (c)(1), (2), (4) Date: Jun. 23, 2009

(87) PCT Pub. No.: WO2007/134946

PCT Pub. Date: Nov. 29, 2007

(65) Prior Publication Data

US 2010/0001556 A1 Jan. 7, 2010

(30) Foreign Application Priority Data

May 24, 2006 (FR) ..... 06 51899

(51) Int. Cl.
*A47C 4/48* (2006.01)

(52) U.S. Cl. ..... 297/16.2; 297/25; 297/26; 297/42

(58) Field of Classification Search ..... 297/42, 297/16.2, 25, 26, 56
See application file for complete search history.

(56) References Cited

U.S. PATENT DOCUMENTS

| | | | | |
|---|---|---|---|---|
| 1,215,689 | A | 2/1917 | Neff | |
| 4,300,798 | A * | 11/1981 | Musgrove et al. | 297/184.15 X |
| 6,371,555 | B1 * | 4/2002 | Edwards et al. | 297/228.1 X |
| 2006/0071512 | A1 | 4/2006 | Saakyan | |

FOREIGN PATENT DOCUMENTS

| | | |
|---|---|---|
| EP | 1535528 A | 6/2005 |
| FR | 1090669 A | 4/1955 |
| FR | 2233011 A1 | 1/1975 |

OTHER PUBLICATIONS

International Search Report dated Aug. 16, 2007.

* cited by examiner

*Primary Examiner* — Anthony D Barfield
(74) *Attorney, Agent, or Firm* — Perman & Green, LLP

(57) ABSTRACT

A foldable rest support including a frame has at least four sections articulated together about an axis to which is associated a bearing surface, two of the sections constituting the suspension arms. According to the disclosed embodiments, two other of the sections constituting the feet of the support, each foot having a truncated V shape, and the bearing surface links the sections constituting the suspension arms in order to at least partially cover at least one of the lateral faces of the foldable support.

12 Claims, 4 Drawing Sheets

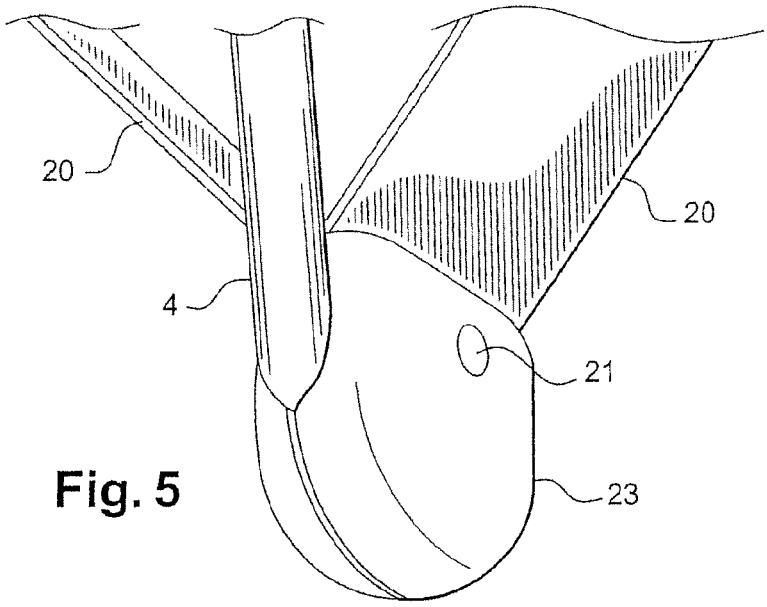
Fig. 5
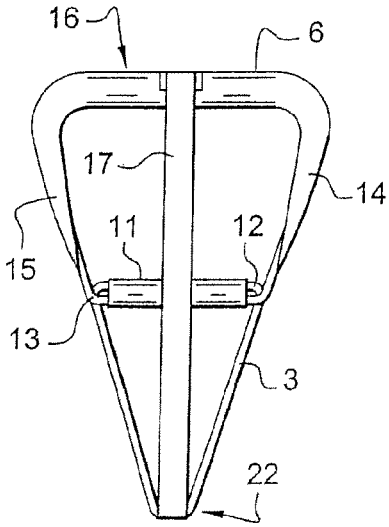
Fig. 4A
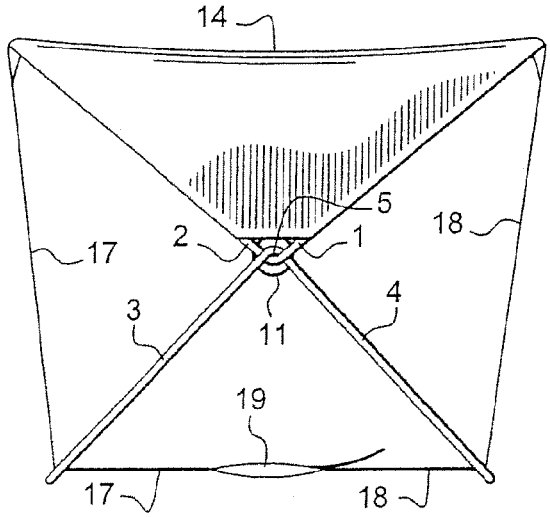
Fig. 4B
Fig. 4

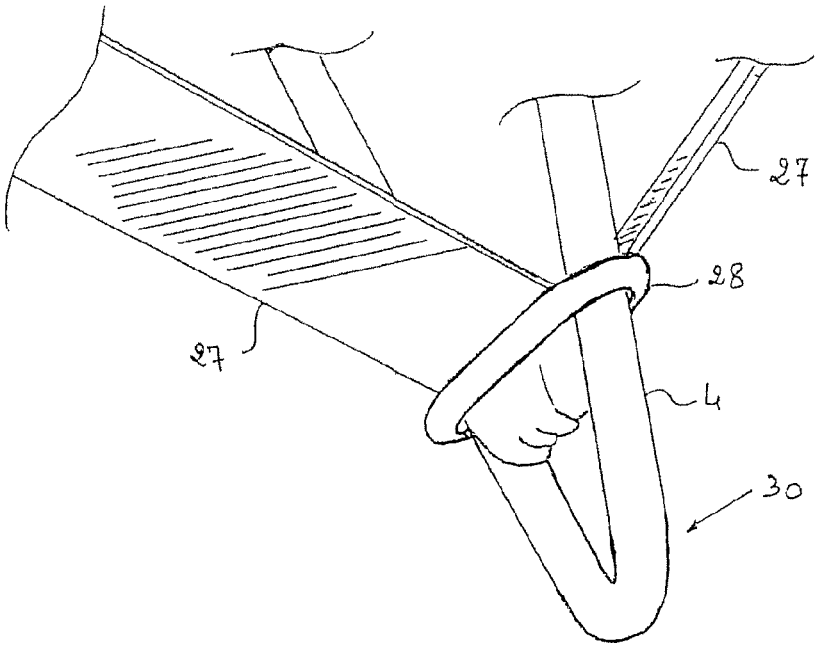
Fig. 6
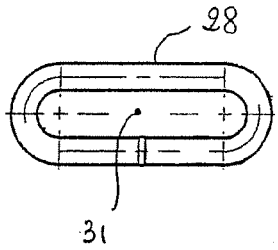
Fig. 7A
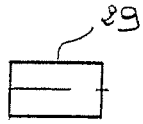
Fig. 7B
Fig. 7
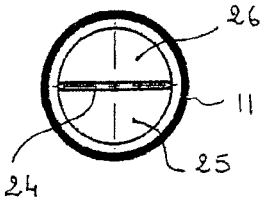
Fig. 8A
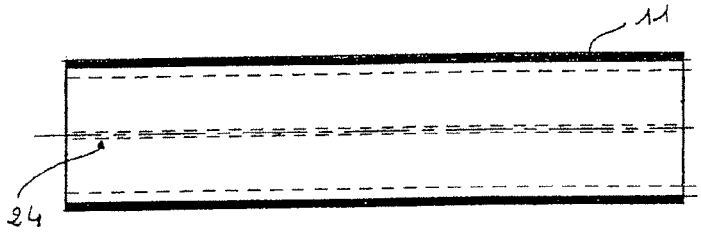
Fig. 8B
Fig. 8

FOLDABLE REST SUPPORT

CROSS REFERENCE TO RELATED APPLICATIONS

This application is the National Stage of International Application No. PCT/EP2007/054073 International Filing Date, 25 Apr. 2007, which designated the United States of America, and which International Application was published under PCT Article 21 (2) as WO Publication No. WO2007/134946 and which claims priority from French Application No. 0651899, filed on 24 May 2006, the disclosures of which are incorporated herein by reference in their entireties.

BACKGROUND

1. Field

The disclosed embodiments relate to a foldable rest support. In particular, a general-purpose rest support having as various functions as those of back, headrest, seat.

2. Brief Description of Related Developments

Known are headrests allowing to users wishing to relax itself to lie down on the ground, the head resting slightly above the ground level on a fabric which is stretched and supported by a frame.

However, the thus formed rest surface, typically rectangular, is plane. Thus, in the event of somnolence, the user's nape can be constrained by the fabric edge, which can cause pains in the nape.

Sophisticated headrests tried to solve this problem by allowing the rotation of the fabric about its longitudinal axis. However, the positioning of the head and the nape remain uncomfortable.

In addition, in these devices, the support height of the head is always set and non-adaptable.

Also known are foldable beach chairs including a frame with which is associated a rectangular fabric stretched between two suspension arms.

These chairs, even folded, are cumbersome objects which cannot be easily transported in a beach bag, for example.

Moreover, these headrests and chairs typically include feet having a broad contact surface with the ground only allowing an implementation on a substantially uniform and stable ground.

The modification of the slope of these devices is very difficult even impossible because they are then unstable and can skid under the user's weight.

Likewise, for applications on unstable grounds such as a sandy ground, they are difficult to implement if the ground surface is irregular.

Lastly, these prior art devices have only one function and thus are specifically designed for a final use which is either the rest of the head, or to form a seat.

It would thus be advantageous to have a support which is for general-purpose use, allowing the user to vary the function of the support according to its needs, which could on a purely illustrative basis act as a thoracic support, a back support in sitting position.

SUMMARY

The aspects of the disclosed embodiments are directed to a foldable rest support, simple in its design and its use procedure, economic and robust, having a very broad bearing surface when it is unfolded for a very low storage volume while allowing many implementations.

Another aspect of the disclosed embodiments is to create a rest support allowing a variation on the head maintaining height and of the support slope even on unstable grounds such as the sand.

To this end, the disclosed embodiments relate to a foldable rest support comprising a frame including at least four sections articulated together about an axis to which is associated a bearing surface, two of said sections constituting the suspension arms.

According to the disclosed embodiments, two others of these sections constituting the feet of the support present each one a truncated V shape, and the bearing surface links the sections constituting the suspension arms in order to at least partially cover at least one of the lateral faces of the foldable support.

Here, it must be understood by "a truncated V shape", the shape of a V from which the apex would have been cut off to form a plane, rounded or curve part at its end allowing the sections constituting the support feet to have with this plane, rounded or curve part a reduced contact surface at the ground.

This reduced contact surface advantageously allows to anchor the sections constituting the support feet into a loose or unstable ground such as sand, when a pressure is exerted on the bearing surface. One thus obtains a very good stability of the support in a broad range of inclination angle, for example from −50° to +50° relative to the vertical.

In various particular embodiments of this rest support, each one having its particular advantages and being likely to many possible technical combinations:

said sections constituting the suspension arms are substantially U-shaped, each side branch of the U being connected to the base of this U by a curved section having an external curvature radius ranging between 15 and 45% of the greatest width I of the corresponding section, it must be understood by "greatest width of the corresponding section", the overall width of this section, the bearing surface is a fabric piece or a non-woven piece made in a flexible plastic material, the bearing surface being a fabric piece, this one includes at least a protecting layer laid out at least partially on the external surface of the piece, after printing of an advertisement or of information in order to protect the printed faces from external aggressions, it includes a strap connecting the ends of the sections, this strap including two portions ready to be coupled together by a connecting device so as to maintain the spacing between these sections when the support is unfolded, at least one of said sections constituting the feet includes a removable fastener, this fastener ensuring the securing of a strap portion on said section, this strap portion being connected to one of its ends at the corresponding end of one of the sections constituting the suspension arms and including at its other end a coupling element intended to cooperate with a coupling element of another strap portion in order to secure said strap portions together, this fastener is a removable shoe fixed at the truncated end of said section constituting a foot of the support, preferably, this shoe includes a strap portion intended to be connected at the corresponding end of one of the sections constituting the suspension arms, the strap having in addition a coupling element intended to cooperate with a coupling element of another strap portion in order to secure these straps together, this fastener includes a link and a blocking nut, this fastener advantageously allows to fix the remote strap portion of the lower end of the section constituting a foot of the support, this lower end being that intended to be in contact with the ground. One thus avoids the stain and wear of the strap noted with the headrests of the state of the art, the coupling elements form a connecting device with engagement.

The disclosed embodiments will be further described with reference to the annexed drawings in which:

BRIEF DESCRIPTION OF THE DRAWINGS

FIG. 4 is a rear view (FIG. 4*a*) and a front view (FIG. 4*b*) of the FIG. 1 support;

FIG. 5 is a diagrammatic representation of the end of a section having a truncated V shape having a shoe according to a second embodiment;

FIG. 6 is a diagrammatic representation of the end of a section having a truncated V shape comprising a fastener for a strap according to a third embodiment;

FIG. 7 is a top view of a link (FIG. 7*a*) and a front view (FIG. 7*b*) of the blocking nut of the blocking element of FIG. 6;

FIG. 8 is a front view (FIG. 8*a*) and a profile view (FIG. 8*b*) of a tube intended to receive the ends of the sections constituting the feet and the suspension arms of a support according to a fourth embodiment.

DETAILED DESCRIPTION OF THE DISCLOSED EMBODIMENTS

Figure 1:
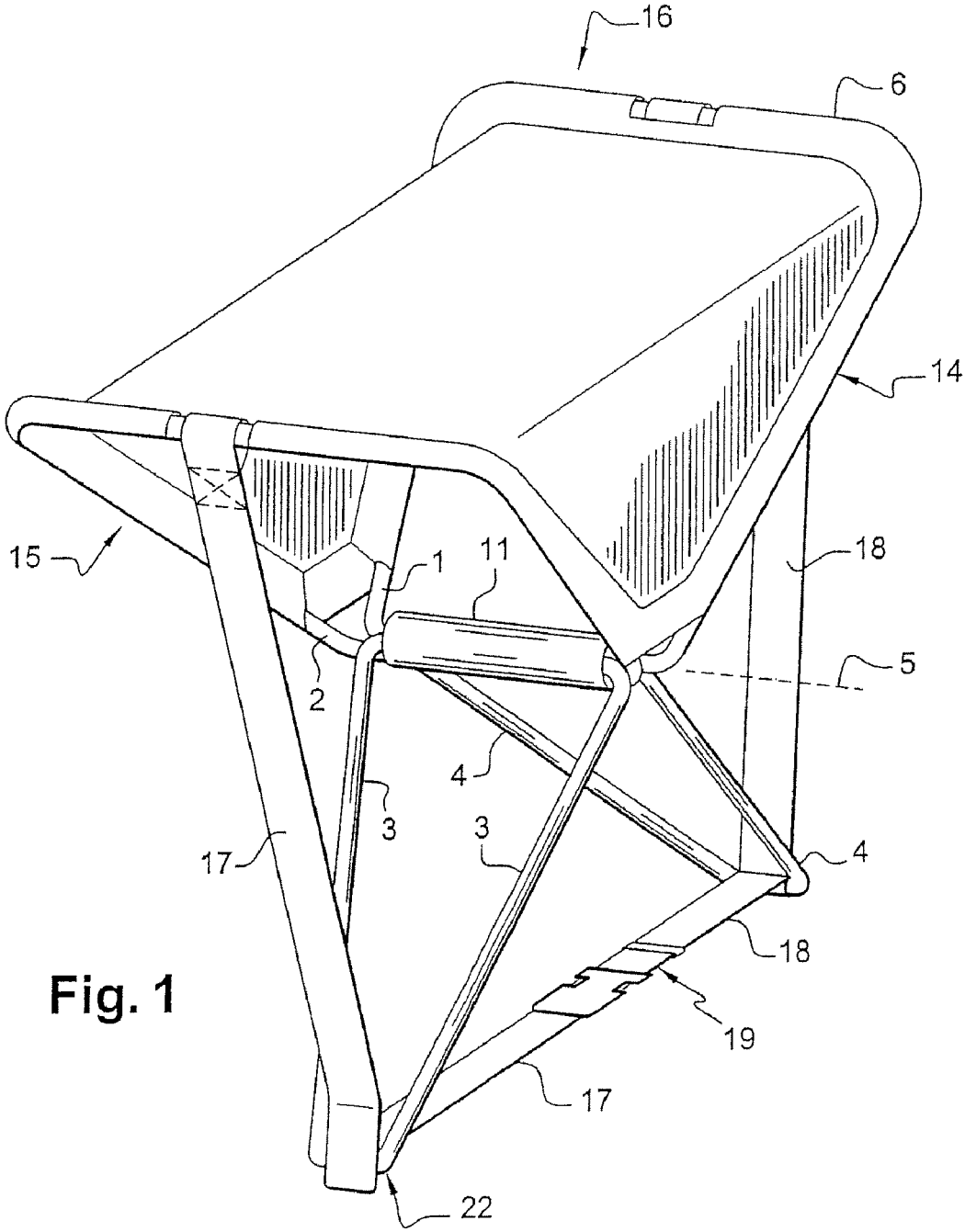
FIG. 1 is a perspective representation of a support according to a first embodiment.

FIG. 1 shows a foldable rest support according to a particular embodiment. This support comprises a frame including four sections 1-4 articulated together about an axis 5 to which is associated a bearing surface 6.

Each one of these sections 1-4 can be carried out from only one stem whose constitutive material is selected in the group including steel, stainless steel, aluminum, composite materials and a hard plastic material such as polyamide 6,6.

Figure 3:
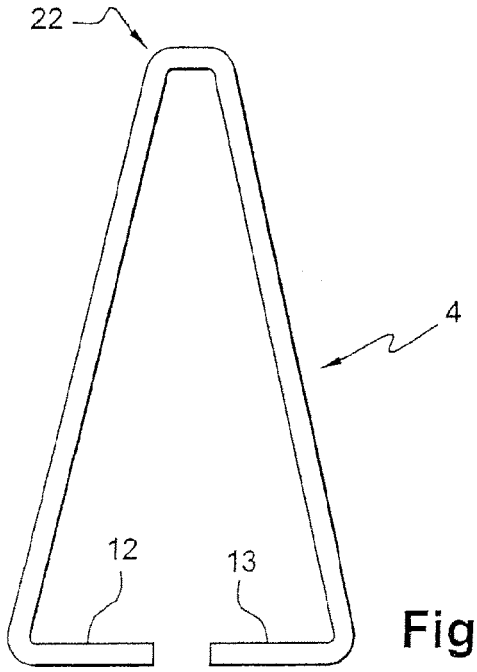
FIG. 3 is a diagrammatic representation of a section having the truncated V shape of the FIG. 1 support.

Two of these sections constituting the feet 3, 4 of the support present a truncated V shape 22 (FIG. 3). These sections 3, 4 have thus a reduced contact surface at the ground.

On a purely illustrative basis, this section 3, 4 being obtained from a white stem made of zinc coated steel with a diameter of about 6 mm, the length of the stem portion intended to form a contact surface at the ground is of 12 mm+/−10%. The stem is curved to an angle of about 102° from this stem portion. The height of this section is about 200 mm.

Figure 2:
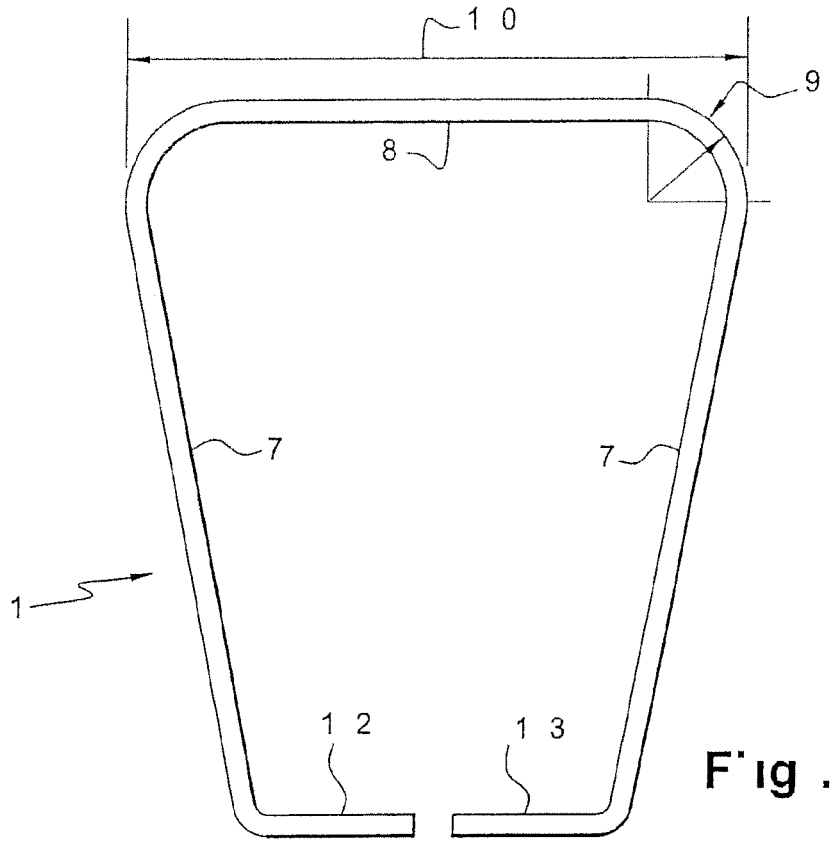
FIG. 2 is a diagrammatic representation of a section constituting a suspension arm of the support of FIG. 1.

Two other sections form the suspension arms 1, 2 (FIG. 2). Preferably, each one of these sections 1, 2 is substantially U-shaped, each of the side branches 7 of the U being connected to base 8 of the U by a curved section 9 having an external curvature radius ranging between 15 and 45% of the greatest width I 10 of this section. In this particular embodiment and on a purely illustrative basis, the greatest width 10 of the section being of 200 mm+/−10%, the external curvature radius is from 30 to 90 mm+/−10%.

These sections 1-4 are articulated about an axis 5 defined by a tube 11 in which are inserted ends 12, 13 of these sections. This tube 11 can be hollow or include housings intended to receive said ends. The hollow tube, for example, is produced from a material selected into the group including steel, aluminum alloys or stainless steel. The including tube housings can be an unitary part molded in plastic or alternatively be constituted in composite material.

This tube 11 can still include an partition element 24 inserted into the tube in order to divide the interior volume of this one in two separate compartments 25, 26 (FIG. 8). This partition element 24 is for example a plastic strip of a width substantially equal to the internal diameter of tube 11. This partition element 24 advantageously allows to prevent a possible crossing of the sections 1-4 ends constituting the support feet and suspension arms.

The bearing surface 6 connects the sections constituting the suspension arms 1, 2 so as to partially cover the lateral faces 14, 15 of the foldable support as its higher part 16 by forming an extensible continuous surface. In this embodiment, the bearing surface 6 is a fabric piece but the bearing surface 6 could also be carried out in an extensible plastic material.

The inventive support can thus take two positions as a headrest, which offers two possible heights to the user. A first position is obtained with the support placed in vertical position (FIG. 1). The head of the user is then supported by the higher part 16 while the nape is advantageously supported by a lateral face 14, 15 of the bearing surface. A second maintaining position is obtained by laying down the support on the ground. The user's nape comes then to take support against the higher part 16 of the support while its head is resting against a lateral face 14, 15 of the bearing surface 6.

The fabric piece can be made of cotton, polyester, acrylic, polypropylene or of a woven structure including, on its external surface, at least a layer of Neoprene to obtain a soft to the feel external surface.

The fabric piece can still be carried out in a printable fabric in order to print or to realize a screen printing of a message or an advertising pattern, or still an information message on its surface. The inventive support can thus be used as an advertising medium.

Advantageously, this fabric piece includes at least a protecting layer laid out at least partially on the external surface of this piece, after printing of an advertisement or information message to protect the printed face(s) from external aggressions.

This bearing surface 6 further is removable. It can thus be uncovered for washing or repair or change.

This support includes a strap connecting the ends of said sections, this strap including two portions 17, 18 ready to be coupled together by a connecting device 19 so as to maintain the spacing between sections 1-4 when the support is unfolded, or in the use position. This connecting device 19 is preferably a connecting device with engagement made of polypropylene. This connecting device is, as an example, a fork loop. The two strap portions 17, 18 can also be made of polypropylene or polyester or of cotton.

The support can also include fixing means for a sun-shield element (not represented). These fixing means can include a plastic support coming to adapt on or grip one of the sections constituting the suspension arms 1, 2 of the support.

This sun-shield element includes a hinged arm so that said sun-shield element can be oriented in all the directions.

FIG. 5 shows another embodiment of the inventive support. One of, or both, sections constituting the feet 3, 4 of this support includes a removable shoe 23 fixed at its truncated end. This shoe 23 includes a strap portion 20 intended to be connected at the corresponding end of one of the sections constituting the suspension arms 1, 2. This strap 20 comprises a coupling element (not represented) intended to cooperate with a coupling element of another strap portion to secure the straps together. Preferably, these coupling elements form a connecting device with engagement.

This shoe 23 can be a molded piece including two parts, each one of these parts comprising a groove having the form of at least a part of the end of said section to fit this one during its assembly. This piece can be made of plastic or metal.

The assembly of the two parts of the shoe 23 can be obtained by any known securing means, in particular by engagement, screwing 21 or welding. In the case of a securing by engagement, a first part can include pins intended to cooperate with corresponding holes carried out in the second part. These pins, for example, are inserted forcedly into these holes.

This shoe 23 can also have in its lower part a non-skid surface (not represented) allowing to reinforce the hanging of the support feet on the ground, in particular, on a hard ground.

This shoe 23 further allows to avoid the wear of the strap such as one can observe it with the prior art devices, in which the strap connected directly to the feet ends is repeatedly in contact with a rough ground.

This shoe also allows not to sew the strap around the truncated end 22 of the sections constituting the support feet 3, 4 which simplifies the manufacture of the support.

Lastly, this shoe 23 allows to give a pointed form to the support foot conferring to him a better penetration into an unstable ground and thus a better stability to the support.

FIG. 6 shows a third embodiment of the inventive support. One of the sections, or both, constituting the feet 3, 4 of this support includes a fastener of a strap portion 27 intended to be connected at the corresponding end of one of the sections constituting the suspension arms 1. This strap portion 27 includes as previously described, a coupling element (not represented) intended to cooperate with a coupling element of another strap portion.

This fastener of the strap portion 27 on the foot section 3, 4 includes a link 28 and a blocking nut 29. These elements can be made of rigid plastic or of metal.

Advantageously, and due to the truncated V shape 30 of each of the sections constituting the support feet 3, 4, the link 28 can slide along these sections up to a given height where it is stopped against those. This height relative to the ground is determined by the dimensions of the internal space 31 defined by the link 28 and the spacing of the arms of V.

The strap portion 27 is then introduced by the operator inside the link 28 and it is blocked in position by the blocking nut 29. For that, the operator makes the blocking nut 29 to penetrate forcedly into the internal space 31 of the link 28.

The strap portion 27 is thus assembled to the foot section 3, 4 at a certain distance from the end of the foot section, intended to be in contact with the ground.

This fastener 28, 29 thus allows to avoid the wear of the strap portion 27 noted with the prior art devices. Indeed, into these devices, the strap being connected directly at the feet ends, it is repeatedly in contact with a rough ground.

Since the strap portion 27 is placed in withdrawal compared to the ground, dirtying this one is also avoided. The maintenance of the support is thus facilitated.

Lastly, the manufacture of the support is, in a general way, significantly simplified. With the prior art devices, the positioning of the strap seam at the feet end was crucial to preserve the symmetry of the support and to avoid a premature wear of this seam because of the forces being exerted on it.

The sewing operation was thus particularly delicate and painful for the operator.

Moreover, and by comparison with the support described on FIG. 1 in which the strap portion 17, 18 is secured by sewing at the lower end of the foot section 3, 4, the seam being very solicited mechanically since working under tearing, the fastener 28, 29 allows to reinforce the safety of the support. Indeed, the stresses are mainly absorbed by the link 28.

The inventive rest support can advantageously be implemented as a back, the angle between the bust and the legs being then adjustable by sloping the support, or as a chair or headrest or still in side body, thoracic support or support of the legs or the feet.

The invention claimed is:

1. A foldable rest support comprising:

a frame including at least four sections articulated together about an axis to which is associated a bearing surface, two of said sections constituting suspension arms, two other of said sections constituting feet of said support, each foot having a truncated V shape, and in that said bearing surface links said sections constituting the suspension arms in order to at least partially cover at least one of one or more lateral faces of said foldable support, wherein said sections constituting the suspension arms are substantially U-shaped, each side branch of each U shaped section being connected to a base of said U shaped section by a curved section having an external curvature radius ranging between 15 and 45% of the greatest width I of said corresponding section.

2. A support according to claim 1, wherein said bearing surface is a fabric piece or a non-woven piece made in a flexible plastic material.

3. A support according to claim 2, wherein said fabric piece comprises at least a protecting layer laid out at least partially on an external surface of said piece, after printing of an advertisement or of information on the external piece, in order to protect the printed external surface from external aggressions.

4. A support according to claim 1, wherein said bearing surface is removable.

5. A support according to claim 1, comprising a strap connecting the ends of said sections, said strap including two portions ready to be coupled together by a connecting device so as to maintain the spacing between said sections when said support is unfolded.

6. A support according to claim 5, wherein said connecting device comprises a connecting device with engagement.

7. A support according to claim 1, wherein at least one of said sections constituting the feet includes a removable fastener, said fastener ensuring the securing of a strap portion on said section, said strap portion being connected at one of its ends to the corresponding end of one of said sections constituting the suspension arms and including at its other end a coupling element intended to cooperate with a coupling element of another strap portion in order to secure said strap portions together.

8. A support according to claim 1, wherein said axis comprises a tube in which are inserted ends of said sections of the frame, said sections being articulated about the tube.

9. A support according to claim 1, comprising fixing means for a sun-shield element.

10. A foldable rest support comprising:

a frame including at least four sections articulated together about an axis to which is associated a bearing surface, two of said sections constituting suspension arms, two other of said sections constituting feet of said support, each foot having a truncated V shape, and in that said bearing surface links said sections constituting the suspension arms in order to at least partially cover at least one of one or more lateral faces of said foldable support, wherein at least one of said sections constituting the feet includes a removable fastener, said fastener ensuring the securing of a strap portion on said section, said strap portion being connected at one of its ends to the corresponding end of one of said sections constituting the suspension arms and including at its other end a coupling element intended to cooperate with a coupling element of another strap portion in order to secure said strap portions together, and wherein said fastener comprises a removable shoe secured at the truncated end of said section constituting a foot of said support.

11. A support according to claim 10, wherein said shoe includes a non-skid on the ground surface to prevent a possible slip of said sections constituting the feet on the ground.

12. A foldable rest support comprising:

a frame including at least four sections articulated together about an axis to which is associated a bearing surface, two of said sections constituting suspension arms, two other of said sections constituting feet of said support, each foot having a truncated V shape, and in that said bearing surface links said sections constituting the suspension arms in order to at least partially cover at least one of one or more lateral faces of said foldable support, wherein at least one of said sections constituting the feet includes a removable fastener, said fastener ensuring the securing of a strap portion on said section, said strap portion being connected at one of its ends to the corresponding end of one of said sections constituting the suspension arms and including at its other end a coupling element intended to cooperate with a coupling element of another strap portion in order to secure said strap portions together, and wherein said fastener includes a link and a blocking nut.

* * * * *